US011859362B2

(12) United States Patent
Farley

(10) Patent No.: US 11,859,362 B2
(45) Date of Patent: Jan. 2, 2024

(54) SELF-FILLING EROSION CONTROL APPARATUS

(71) Applicant: Daniel K Farley, Traverse City, MI (US)

(72) Inventor: Daniel K Farley, Traverse City, MI (US)

( * ) Notice: Subject to any disclaimer, the term of this patent is extended or adjusted under 35 U.S.C. 154(b) by 381 days.

(21) Appl. No.: 17/308,752

(22) Filed: May 5, 2021

(65) Prior Publication Data

US 2021/0355644 A1 Nov. 18, 2021

Related U.S. Application Data

(60) Provisional application No. 63/023,323, filed on May 12, 2020.

(51) Int. Cl.
*E02B 3/12* (2006.01)
*E02B 3/04* (2006.01)

(52) U.S. Cl.
CPC ..... *E02B 3/127* (2013.01)

(58) Field of Classification Search
CPC . E02B 3/04; E02B 3/127; E02D 17/20; E02D 17/202
See application file for complete search history.

(56) References Cited

U.S. PATENT DOCUMENTS 749,722 A * 1/1904 Dalton ..... A45C 3/00 224/677
3,653,216 A 4/1972 Stickler, Jr.
3,957,098 A 5/1976 Hepworth et al.
4,000,619 A * 1/1977 Ziegler ..... E02B 3/04 405/16
4,657,433 A * 4/1987 Holmberg ..... E02B 3/04 405/21
4,690,585 A * 9/1987 Holmberg ..... E02B 3/127 405/15
4,770,561 A 9/1988 Holmberg
5,190,403 A 3/1993 Atkinson
5,354,132 A 10/1994 Young et al.
(Continued)

FOREIGN PATENT DOCUMENTS

FR 2367146 A * 6/1978 ..... E02B 3/04

*Primary Examiner* — Frederick L Lagman
*Assistant Examiner* — Stacy N Lawson
(74) *Attorney, Agent, or Firm* — McAndrews, Held & Malloy, Ltd.

(57) ABSTRACT

An erosion control apparatus includes a flexible, container and a cord. The container includes a container upper side, a container lower side opposite the container upper side, a container trailing end, a container leading end opposite the container trailing end, and a container mouth toward the container leading end. The container mouth provides an opening to a container interior. The cord is attached between the container mouth and an attachment point toward the container trailing end. The cord draws the container mouth toward the container trailing end due to a length of the cord between the container mouth and the attachment point being shorter than a length of the container between the container mouth and the attachment point. The cord further draws the container mouth toward a closed position as sediment enters the container mouth, fills the container interior, and urges the container leading end away from the attachment point.

20 Claims, 6 Drawing Sheets

(56) References Cited

U.S. PATENT DOCUMENTS

| | | | | |
|---|---|---|---|---|
| 5,669,732 | A | 9/1997 | Truitt | |
| 6,190,088 | B1 | 2/2001 | Van Der Hidde et al. | |
| 6,312,192 | B1 * | 11/2001 | Dery | E02B 3/108 405/91 |
| 10,287,038 | B2 | 5/2019 | Boutwell | |
| 2014/0161371 | A1 | 6/2014 | Moreau et al. | |

* cited by examiner

SELF-FILLING EROSION CONTROL APPARATUS

BACKGROUND OF THE INVENTION

The present invention relates to structures that help reduce erosion, and in particular to structures that help reduce erosion along river banks and shorelines caused by environmental forces such as wind and water currents.

A variety of structures have been used along river banks and shorelines in attempts to reduce further erosion of the river banks and shorelines. For example, sandbags have been placed along river banks and/or shorelines with the hopes of preventing or reducing erosion due to environmental forces. While such sandbags may be effective in reducing erosion. Filling sandbags and placing them into the water along river banks and shorelines is time-consuming and back-breaking work.

Limitations and disadvantages of conventional and traditional approaches should become apparent to one of skill in the art, through comparison of such systems with aspects of the embodiments set forth in the remainder of the present disclosure.

BRIEF SUMMARY OF THE INVENTION

An erosion control apparatus generally includes a flexible container having a mouth or opening to its interior. The container may be secured to a surface such as the bed or floor of a body of water. The container may be positioned such that environmental forces (e.g. wind or water currents) direct sediment into the interior of the container via its mouth. The container further includes a cord attached to the mouth of the container and configured to close the mouth of the container as the container is filled with sediment. In particular, the cord may include a noose at one end and may be anchored at the opposite end. A loop of the noose may circumscribe the mouth of the container and tighten around the mouth as sediment urges the mouth away from the anchored end of the cord.

Advantages, aspects, novel features, as well as, details of illustrated embodiments will be more fully understood from the following description and figures.

DETAILED DESCRIPTION OF THE INVENTION

Figure 1:
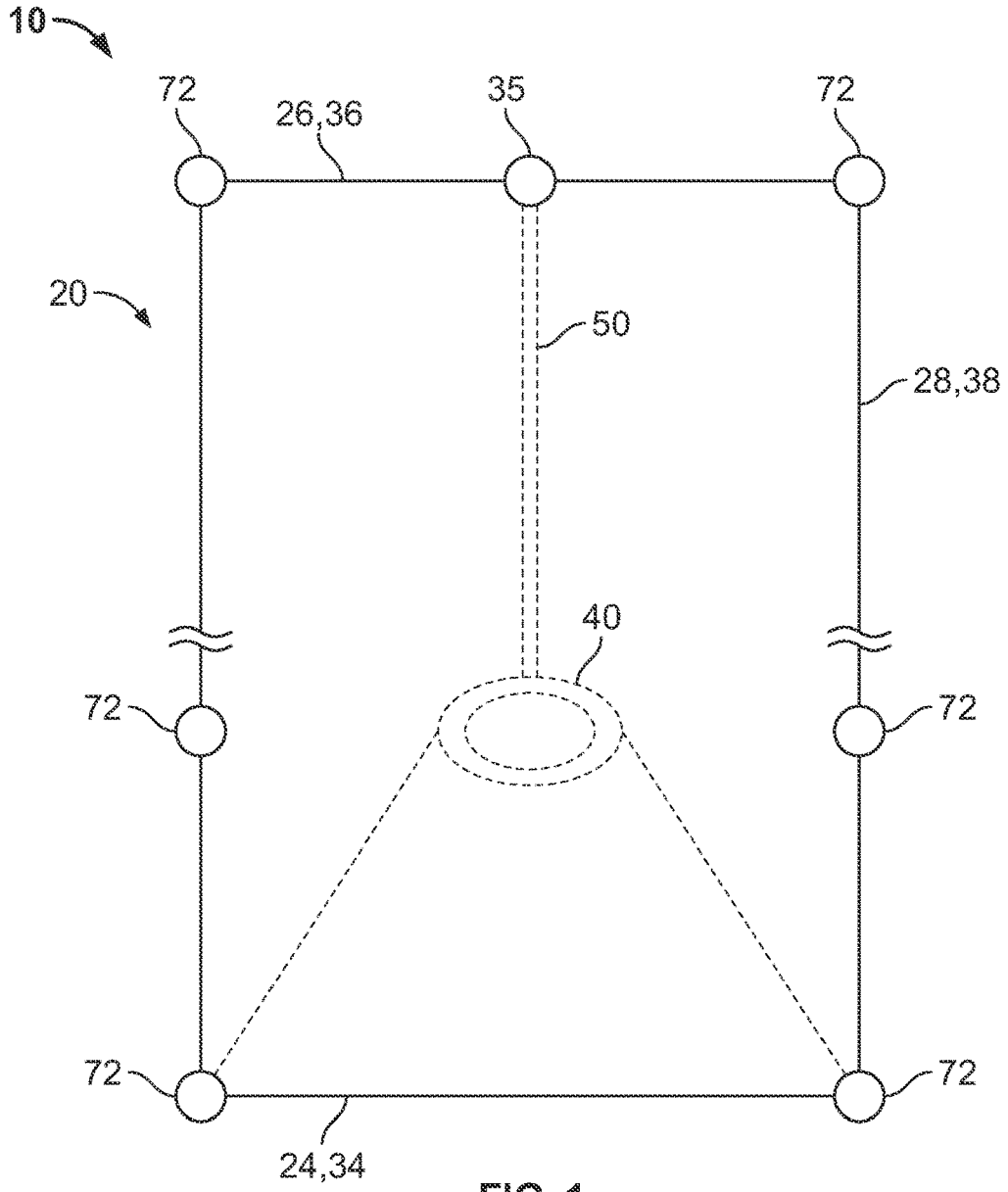
FIG. 1 is a top view of an erosion control apparatus per one or more embodiments described herein.

The following discussion presents various aspects of the present disclosure by providing examples thereof. Such examples are non-limiting, and thus the scope of various aspects of the present disclosure should not necessarily be limited by any particular characteristics of the provided examples. In the following discussion, the phrases "for example," "e.g.," and "exemplary" are non-limiting and are generally synonymous with "by way of example and not limitation," "for example and not limitation," and the like.

As utilized herein, "and/or" means any one or more of the items in the list joined by "and/or". As an example, "x and/or y" means any element of the three-element set {(x), (y), (x, y)}. In other words, "x and/or y" means "one or both of x and y." As another example, "x, y, and/or z" means any element of the seven-element set {(x), (y), (z), (x, y), (x, z), (y, z), (x, y, z)}. In other words, "x, y and/or z" means "one or more of x, y, and z."

The terminology used herein is for the purpose of describing particular examples only and is not intended to be limiting of the disclosure. As used herein, the singular forms are intended to include the plural forms as well, unless the context clearly indicates otherwise. It will be further understood that the terms "comprises," "includes," "comprising," "including," "has," "have," "having," and the like when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, etc. may be used herein to describe various elements, these elements should not be limited by these terms. These terms are only used to distinguish one element from another element. Thus, for example, a first element, a first component or a first section discussed below could be termed a second element, a second component or a second section without departing from the teachings of the present disclosure. Similarly, various spatial terms, such as "upper," "lower," "side," and the like, may be used in distinguishing one element from another element in a relative manner. It should be understood, however, that components may be oriented in different manners, for example a structure may be turned sideways so that its "top" surface is facing horizontally and its "side" surface is facing vertically, without departing from the teachings of the present disclosure.

In the drawings, various dimensions (e.g., layer thickness, width, etc.) may be exaggerated for illustrative clarity. Additionally, like reference numbers are utilized to refer to like elements through the discussions of various examples.

The following description refers to various example illustrations, which are provided to enhance the understanding of the various aspects of the present disclosure. It should be understood that the scope of this disclosure is not limited by the specific characteristics of the examples provided and discussed herein.

The present disclosure is generally directed to an erosion control apparatus. The erosion control apparatus generally includes a flexible container having a mouth or opening to its interior. The container may be secured to a surface such as the bed or floor of a body of water. The container may be positioned such that environmental forces (e.g. wind or water currents) direct sediment into the interior of the container via its mouth. The container further includes a cord attached to the mouth of the container and configured to close the mouth of the container as the container is filled with sediment. In particular, the cord may include a noose at one end and may be anchored at the opposite end. A loop of the noose may circumscribe the mouth of the container and tighten around the mouth as sediment urges the mouth away from the anchored end of the cord.

Figure 12:
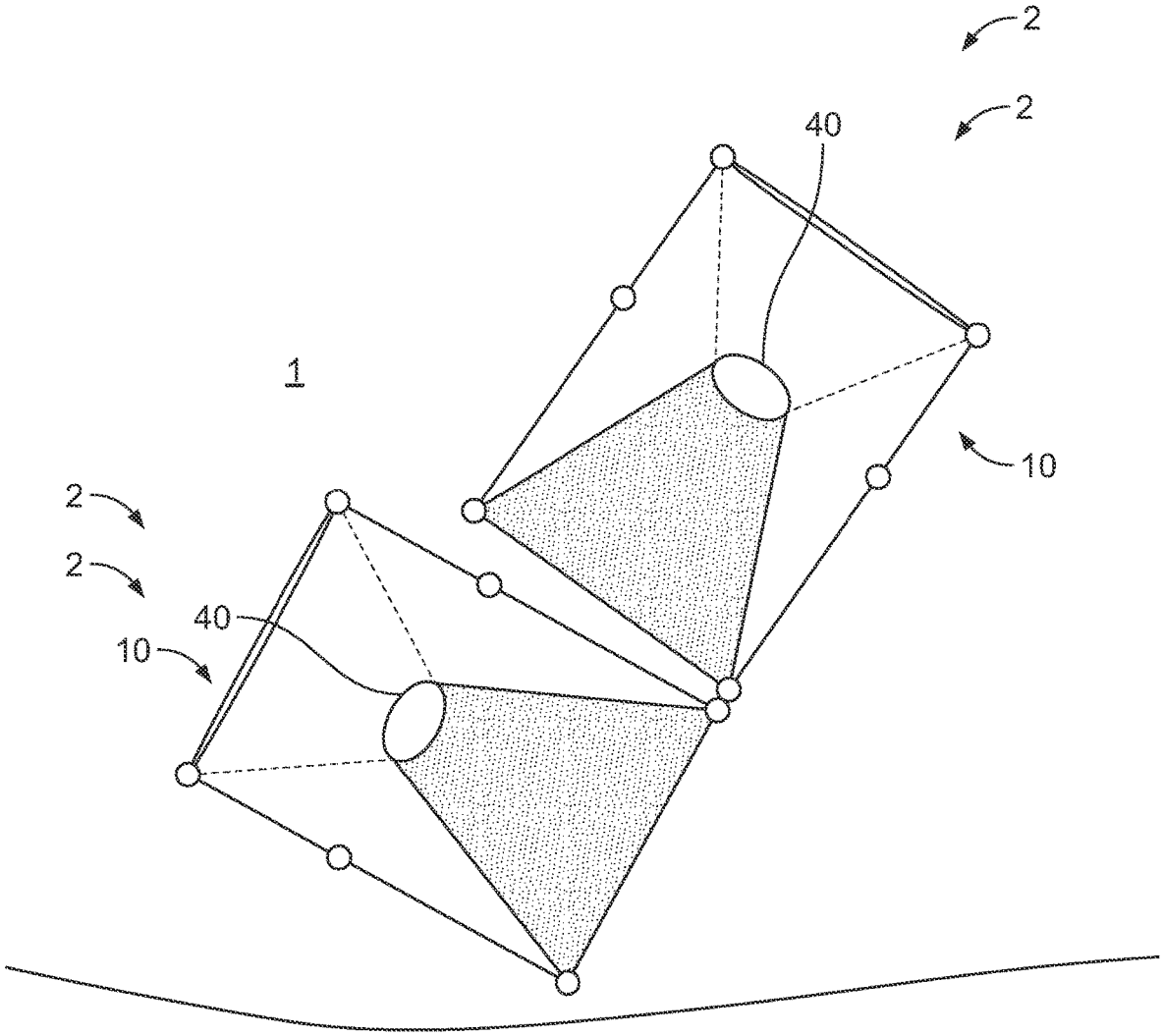
FIG. 12 shows a shoreline with two erosion control apparatus anchored to a bed of a body of water.

Referring now to FIG. 12, two erosion control apparatus 10 are depicted. As shown, the erosion control apparatus 10 may be anchored to a floor, bed, or surface 1 of a body of water. The erosion control apparatus 10 may further be anchored such that container mouths 40 are otherwise directed toward environmental forces (e.g., wind and/or water currents) that carry sediment. In this manner, the erosion control apparatus 10 may receive sediment via container mouths 40 and thus may fill with sediment over period of time without human intervention. As further shown, topology or other factors may result in environmental forces 2 being directed toward the erosion control apparatus 10 from multiple directions. As such, erosion control apparatus 10 may be oriented in a staggered configuration so as to direct container mouths 40 of different erosion control apparatus 10 toward different environmental forces.

Figure 2:
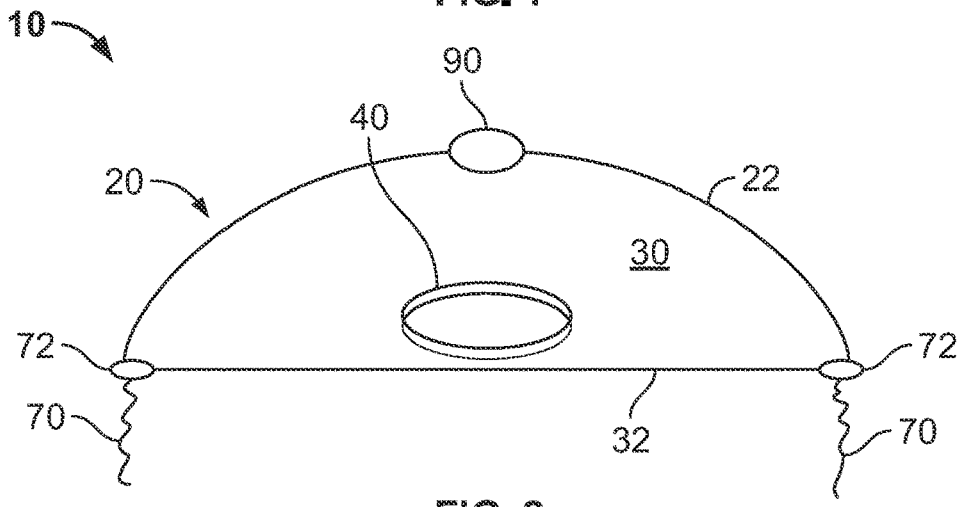
FIG. 2 is a front view of the erosion control apparatus shown in FIG. 1.
Figure 3:
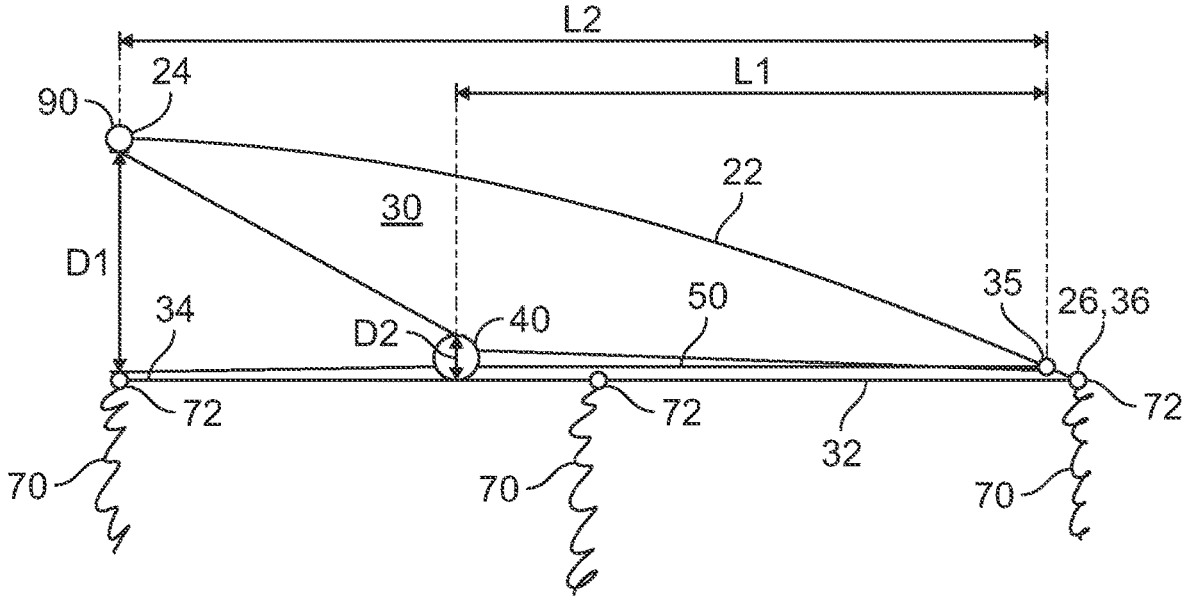
FIG. 3 is a cross sectional view of the erosion control apparatus shown in FIG. 1.

Further details of one embodiment of the erosion control apparatus 10 are shown in FIGS. 1-3. As shown, the erosion control apparatus 10 includes a container 20, a cord 50, anchors 70, and float 90. The container 20 includes a container upper side 22 and a container lower side 32 opposite the container upper side 22. The container upper side 22 includes a leading end 24, a trailing end 26 opposite the leading end 24, and lateral sides 28. The lateral sides 28 join the leading end 24 to the trailing end 26. The container lower side 32 includes a leading end 34, a trailing end 36 opposite the leading end 34, and lateral sides 38. The lateral sides 38 join the leading end 34 to the trailing end 36. The container 20 also includes a container mouth 40 between the leading ends 24, 34. The container mouth 40 provides an opening to a container interior 30.

As shown in FIG. 3, a float 90 may be coupled to leading end 24 of the container upper side 22. The float 90 may bias the container upper side 22 away from the container lower side 32 when the container 20 is anchored to a bed of a body of water. Such biasing may separate the leading ends 24, 34 apart by a distance D1 that is greater than a diameter D2 of the container mouth 40. In this manner, leading ends 24, 34 and adjoining container surfaces may funnel water and accompanying sediment toward container mouth 40.

In some embodiments, the container 20 is formed from a flexible material such as burlap. Further, the flexible material may be permeable to a fluid such as water that flows into the container interior 30 via the counter mouth 40, but not permeable or at least less permeable to sediment carried by the fluid. Due to the container mouth 40 and the permeable material, sediment may be carried into the container interior 30 via environmental forces such as wind and water currents and trapped within the container interior 30. As such, the container interior 30 may fill with sediment over a period of time without further human intervention after installation.

The cord 50 is attached between the container mouth 40 and an attachment point 35 toward the trailing ends 26, 36. As shown in FIG. 3, the cord 50 draws the container mouth 40 toward the container trailing ends 26, 36. In particular, a length L1 of the cord 50 between the container mouth 40 and the attachment point 35 is shorter than a length L2 of the container 20 between the container leading end 26, 36 and the attachment point 35. Due to its shorter length, the cord 50 positions the container mouth 40 between the leading ends 24, 34 and the trailing ends 26, 36.

The cord 50 further is further configured to close the container mouth 40 based on the sediment in the container interior 30. In particular, the cord 50 may form a noose in which a loop 52 of the noose circumscribes the container mouth 40. See, e.g., FIG. 4A. As sediment fills the container interior 40, the sediment urges the container mouth 40 away from the trailing ends 26, 36 and the attachment point 35. Such urging pulls the cord 50 and tightens the noose or reduces the circumference of the loop 52. The circumference of the loop 52 and the length of the cord 50 may be set such that the cord 50 effectively closes the container mouth 40 when the container interior 30 is full of sediment.

Figure 4A:
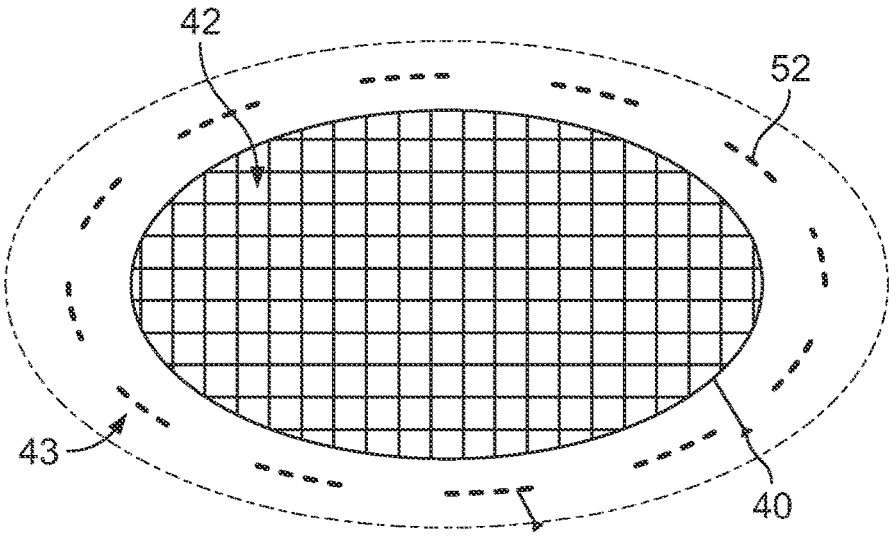
FIG. 4A is a front view depicting a channel of a container mouth of the erosion control apparatus shown in FIG. 1.
Figure 4B:
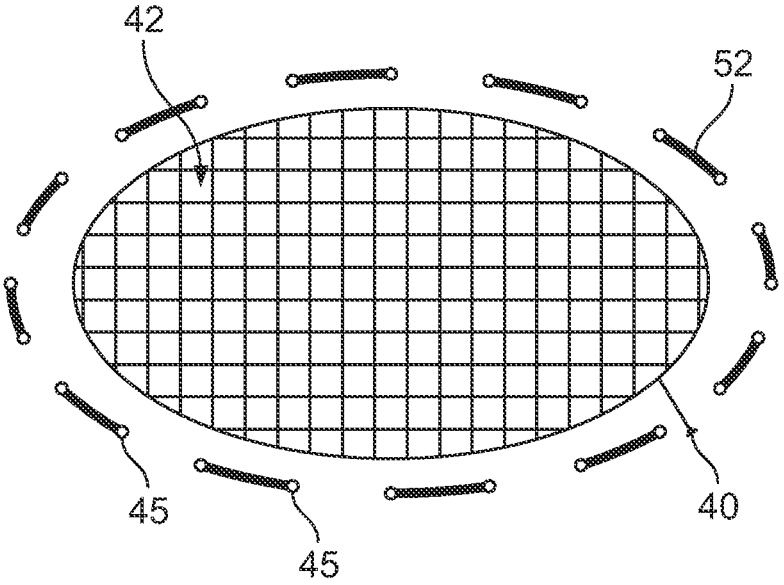
FIG. 4B is a front view depicting a series of holes of a container mouth of the erosion control apparatus shown in FIG. 1.

As shown in FIGS. 4A and 4B, the container mouth 40 may be covered by netting 42. The netting 42 may help prevent fish and other wildlife from entering the container mouth 40 and potentially being trapped within the container.

Figure 5:
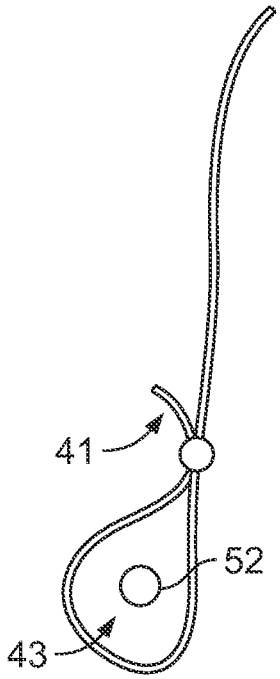
FIG. 5 is a cross sectional view of the container mouth shown in FIG. 4.
Figure 6:
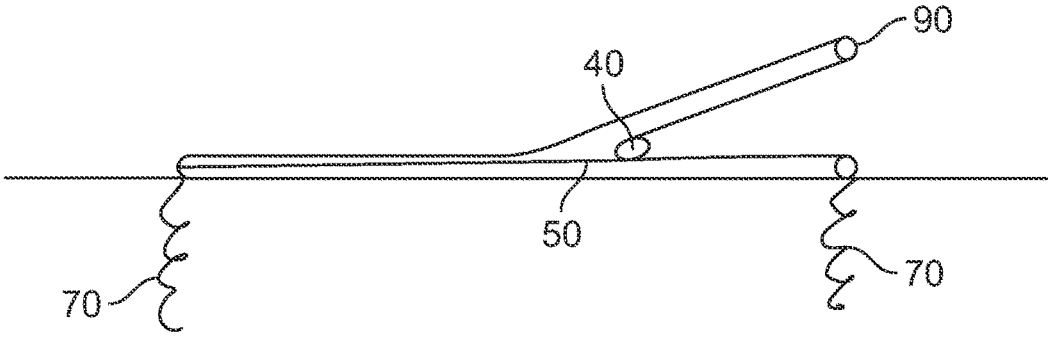
FIG. 6 is a cross sectional view of the erosion control apparatus of FIG. 1 when container interior is empty of sediment and the container mouth in an open position.
Figure 7:
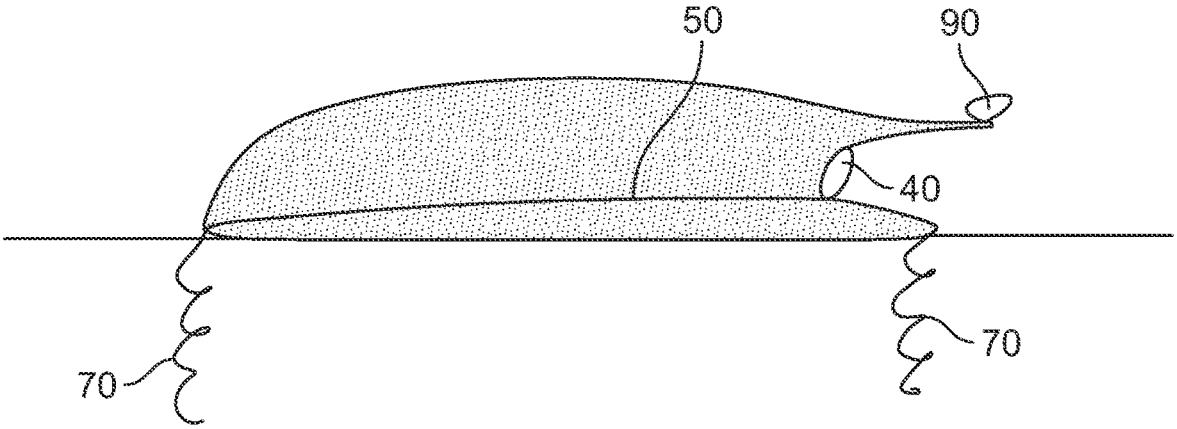
FIG. 7 is a cross sectional view of the erosion control apparatus of FIG. 1 when container interior is partial full of sediment and the container mouth is in a partially closed position.
Figure 8:
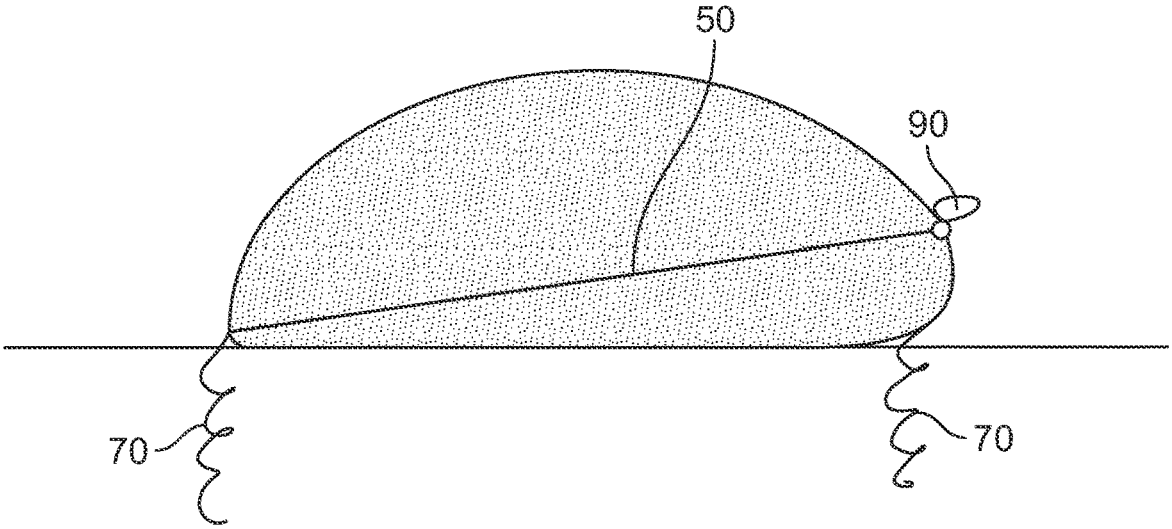
FIG. 8 is a cross sectional view of the erosion control apparatus of FIG. 1 when the container interior is full of sediment and the container mouth is in a closed position.

As shown in FIGS. 4A and 5, the leading end 41 of the container mouth 40 may be folded-over and stitched or otherwise affixed to a container surface to form a channel 43 that circumscribes the container mouth 40. The cord 50 and in particular the loop 52 may pass through the channel 43 and circumscribe the container mouth 40. The channel 43 generally retains the loop 52 about the container mouth 40. Due to such retaining of the loop 52, as the circumference of the loop 52 is reduced due to tightening of the noose, the circumference of the container mouth 40 is likewise reduced.

It should be appreciated that the cord 50 may be retained about the container mouth 40 via other mechanisms. For example, as shown in FIG. 4B, the channel 43 is replaced with a sequence of holes 45 that circumscribe the container mouth 40. The loop 52 of the cord 50 may be threaded through the sequence of holes 45. In some embodiments, grommets may be placed in the holes 45 to reinforce the holes 45. Similar to the channel 43, the holes 45 generally retain the loop 52 about the container mouth 40. Due to such retaining of the loop 52, as the circumference of the loop 52 is reduced due to tightening of the noose, the circumference of the container mouth 40 is likewise reduced.

Referring now to FIGS. 1-3 and 6-8, the erosion control apparatus 10 may include several anchors 70 that anchor the container 20 to a bed of a body of water. To this end, the erosion control apparatus 10 may include a plurality of anchor points 72 about a periphery of the container 10. In some embodiments, the anchors 70 may be coupled to the anchor points 72 via one or ties or lines (not shown) that pass through the anchor points 72. In other embodiments, the anchors 70 may pass through the anchor point 72 and into the bed of a body of water. In some embodiments, the anchor points 72 are merely holes that pass through the material forming the container 20. In such embodiments, the anchor points 72 may further include grommets that are placed in the holes to reinforce the anchor points 72. In other embodiments, the anchor points 72 may include tabs, hooks, or other protrusions that may be either fastened to the anchors 70 via ties, lines, straps, etc. or may directly engage the anchors 70 themselves.

Furthermore, the anchors 70 may take various forms. For example, the anchors 70 may comprise stakes that are to be driven into the bed via impact. In other embodiments, the anchors 70 include a threaded end that permits screwing the anchors 70 into the bed of the body of water.

Figure 9:
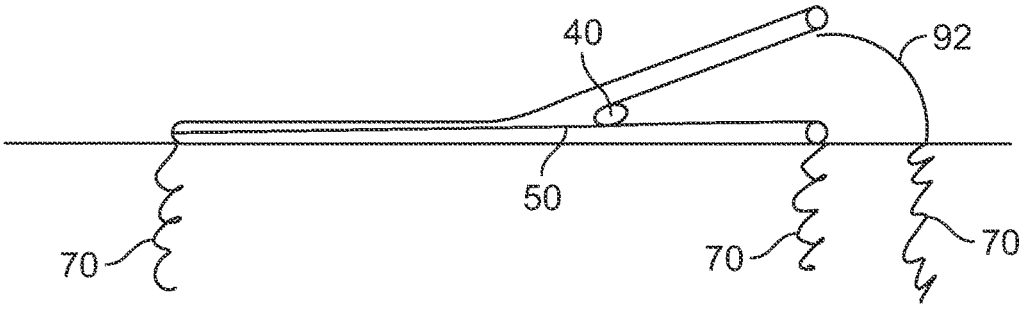
FIG. 9 is a cross sectional view of an erosion control apparatus with a leading edge biased with a spring and the container interior empty of sediment.
Figure 10:
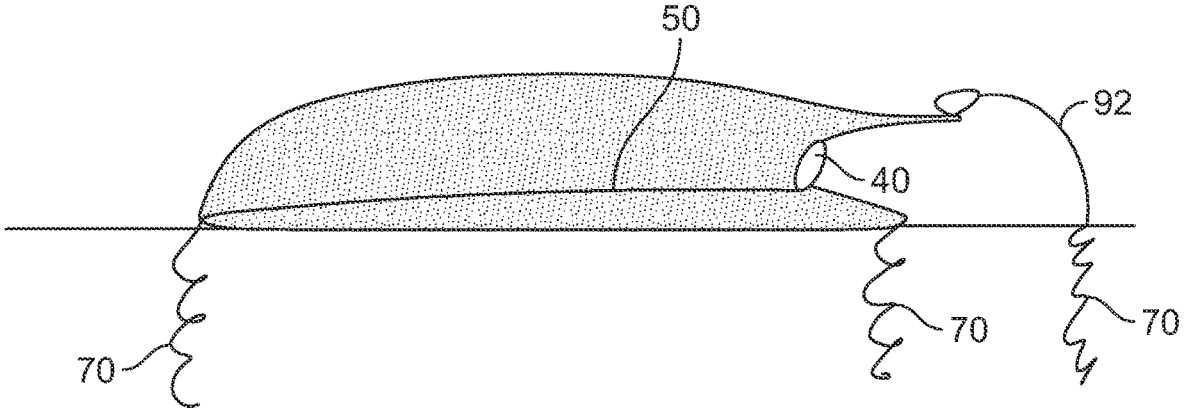
FIG. 10 is a cross sectional view of the erosion control apparatus of FIG. 9 when the container interior is partially full and the container mouth is in a partially closed position.
Figure 11:
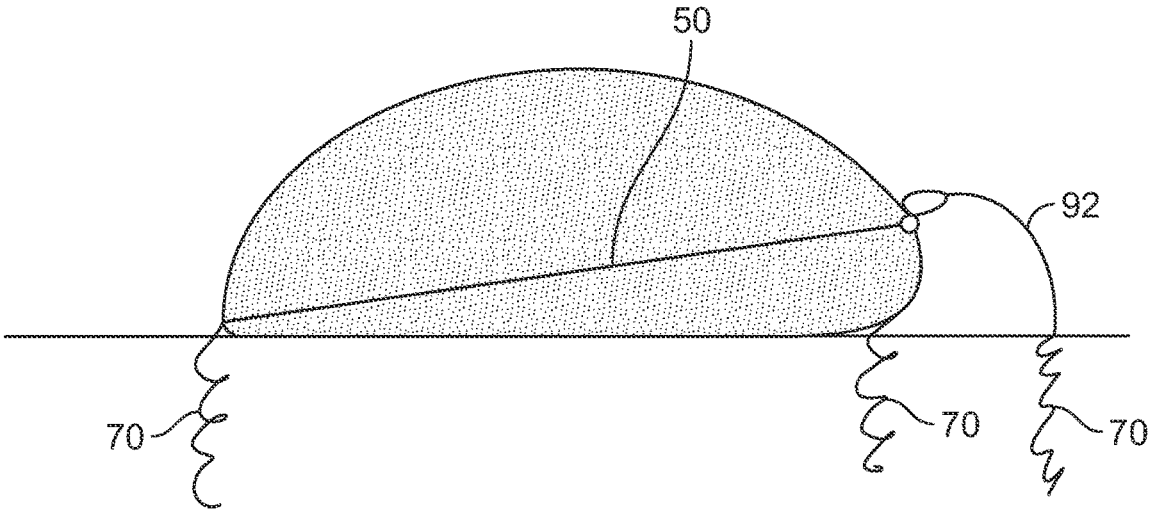
FIG. 11 is a cross sectional view of the erosion control apparatus of FIG. 9 when the container interior is full of sediment and the container mouth is in a closed position.

As explained above, the erosion control apparatus 10 includes float 90 attached to the leading end 24 of the upper side 22. FIGS. 9-11 depict an erosion control apparatus 11. The erosion control apparatus 11 is generally implemented in the same manner as the erosion control apparatus 10 shown in FIGS. 1-8. However, the float 90 of the erosion control apparatus 10 has been replace with a wire spring 92. In particular, one end of the wire spring 92 is coupled to the leading end 24 of the container upper side 22. The other end of the wire spring 92 is coupled to the bed of the body of water via an anchor 70. In this manner, the wire spring 92 like the float 90 biases the leading end 24 of the container upper side 22 away from the leading end 34 of the container lower side 32. Thus, as shown in FIGS. 9 and 10, the leading ends 24, 34 and adjoining container surfaces funnel sediment toward container mouth 40.

One advantage of the embodiment of FIGS. 9-11 is that the erosion control apparatus 11 does not rely upon water level to position the leading end 24. As such, the embodiment of FIGS. 9-11 may be more suitable for installations where the water is shallow. The embodiment of FIGS. 9-11 may also be suitable for land installations in which wind is relied upon to carry sediment into the container interior 30.

While particular embodiments of the invention have been shown, it will be understood that the invention is not limited thereto since modifications may be made by those skilled in the art, particularly in light of the foregoing teaching. It is, therefore, the appended claims which define the true spirit and scope of the invention.

What is claimed is:

1. An erosion control apparatus, comprising:
a flexible container comprising:
a container upper side having an upper leading end and an upper trailing end opposite the upper leading end;
a container lower side opposite the container upper side, the container lower side having a lower leading end and a lower trailing end opposite the lower leading end;
a container mouth between the upper leading end and the lower leading end of the flexible container, wherein the container mouth provides an opening to a container interior; and
a cord attached between the container mouth and an attachment point toward the upper trailing end of the flexible container,
wherein the cord draws the container mouth toward the upper trailing end due to a length of the cord between the container mouth and the attachment point being shorter than a length of the flexible container between the upper leading end of the flexible container and the attachment point;
wherein the cord draws the container mouth toward a closed position as sediment enters the container mouth, fills the container interior, and urges the container mouth away from the attachment point;
wherein a leading end of the container mouth is folded-over and affixed to a container surface to form a channel that circumscribes the container mouth; and
wherein the cord passes through the channel and circumscribes the container mouth.

2. The erosion control apparatus of claim 1, wherein at least a portion of the flexible container is formed from a water permeable material that permits water to flow from the container interior through the water permeable material while retaining sediment in the container interior.

3. The erosion control apparatus of claim 1, comprising a plurality of anchors that anchor the flexible container to a bed of a body of water.

4. The erosion control apparatus of claim 3, wherein:
the flexible container comprises a plurality of anchor points about a periphery of the flexible container; and
the plurality of anchors are coupled to the plurality of anchor points.

5. The erosion control apparatus of claim 4, wherein:
the plurality of anchor points comprise a plurality of holes that pass through the flexible container; and
the plurality of anchors pass through the plurality of holes.

6. The erosion control apparatus of claim 5, wherein:
the plurality of anchor points comprise a plurality of grommets placed in the plurality of holes; and
the plurality of anchors pass through the plurality of grommets.

7. The erosion control apparatus of claim 4, wherein:
the plurality of anchor points comprise a plurality of holes that pass through the flexible container; and
a plurality of lines pass through the plurality of holes and couple the flexible container to the plurality of anchors.

8. The erosion control apparatus of claim 4, wherein:
the plurality of anchor points comprise a plurality of holes that pass through the flexible container and a plurality of grommets in the plurality of holes; and
a plurality of lines pass through the plurality of grommets and couple the flexible container to the plurality of anchors.

9. The erosion control apparatus of claim 1, wherein the attachment point is along the upper trailing end.

10. The erosion control apparatus of claim 1, comprising a netting over the container mouth.

11. The erosion control apparatus of claim 1, wherein the cord forms a noose in which a loop of the noose circumscribes the container mouth.

12. The erosion control apparatus of claim 1, comprising:
a float coupled toward the upper leading end of the flexible container; and
wherein the float biases the container upper side away from the container lower side when the flexible container is anchored to a bed of a body of water.

13. The erosion control apparatus of claim 1, comprising:
a spring coupled toward the upper leading end of the flexible container; and
wherein the spring biases the container upper side away from the container lower side.

14. An erosion control apparatus, comprising:
a flexible container comprising:
a container upper side having an upper leading end and an upper trailing end opposite the upper leading end;
a container lower side opposite the container upper side, the container lower side having a lower leading end and a lower trailing end opposite the lower leading end;

a container mouth between the upper leading end and the lower leading end of the flexible container, wherein the container mouth provides an opening to a container interior; and a cord attached between the container mouth and an attachment point toward the upper trailing end of the flexible container, wherein the cord draws the container mouth toward the upper trailing end due to a length of the cord between the container mouth and the attachment point being shorter than a length of the flexible container between the upper leading end of the flexible container and the attachment point;

wherein the cord draws the container mouth toward a closed position as sediment enters the container mouth, fills the container interior, and urges the container mouth away from the attachment point;

wherein a leading end of the container mouth comprises a sequence of holes that circumscribe the container mouth; and wherein the cord forms a noose in which a loop of the noose is threaded through the sequence of holes and circumscribes the container mouth.

15. The erosion control apparatus of claim 14, wherein at least a portion of the flexible container is formed from a water permeable material that permits water to flow from the container interior through the water permeable material while retaining sediment in the container interior.

16. The erosion control apparatus of claim 14, comprising a plurality of anchors that anchor the flexible container to a bed of a body of water.

17. The erosion control apparatus of claim 14, wherein:

the flexible container comprises a plurality of holes about a periphery of the flexible container; and a plurality of grommets in the plurality of holes.

18. The erosion control apparatus of claim 14, comprising a netting over the container mouth.

19. The erosion control apparatus of claim 14, comprising:

a float coupled toward the upper leading end of the flexible container; and wherein the float biases the container upper side away from the container lower side when the flexible container is anchored to a bed of a body of water.

20. The erosion control apparatus of claim 14, comprising:

a spring coupled toward the upper leading end of the flexible container; and wherein the spring biases the container upper side away from the container lower side.

* * * * *